United States Patent [19]

Bitko

[11] Patent Number: 4,683,355

[45] Date of Patent: Jul. 28, 1987

[54] POSITION INSENSITIVE SHOCK SENSOR

[75] Inventor: Sheldon S. Bitko, East Brunswick, N.J.

[73] Assignee: Fifth Dimension Inc., Trenton, N.J.

[21] Appl. No.: 939,725

[22] Filed: Dec. 9, 1986

[51] Int. Cl.[4] ..... H01H 1/08; H01H 29/00; H01H 35/14

[52] U.S. Cl. ..... 200/61.47; 200/182; 200/220; 200/234; 335/47; 335/58

[58] Field of Search ..... 200/61.47, 182, 183, 200/186, 209, 210, 211, 215–217, 220, 230, 234, 233, 235; 307/121; 335/47, 55, 57, 58

[56] References Cited

U.S. PATENT DOCUMENTS

| | | | |
|---|---|---|---|
| 2,179,640 | 11/1939 | Lakatos | 335/58 |
| 2,288,811 | 7/1942 | Leveridge | 335/58 |
| 2,849,562 | 8/1958 | Heller | 335/58 X |
| 3,141,084 | 7/1964 | Stromberg | 200/186 |
| 3,144,533 | 8/1964 | Donath | 200/234 X |
| 3,308,405 | 3/1967 | Hurvitz | 335/55 X |
| 3,644,693 | 2/1972 | Bitko | 200/234 X |
| 3,646,490 | 2/1972 | Bitko | 200/234 X |
| 3,697,906 | 10/1972 | Bitko | 200/211 X |
| 3,715,546 | 2/1973 | Bitko | 200/230 X |
| 3,739,191 | 6/1973 | Nagazumi et al. | 307/121 |
| 3,786,217 | 1/1974 | Bitko | 200/210 X |
| 3,831,118 | 8/1974 | Bitko | 335/47 |
| 3,867,603 | 2/1975 | Bitko | 200/234 X |
| 3,976,960 | 8/1976 | Bitko et al. | 335/58 |
| 3,978,301 | 8/1976 | Bitko | 200/220 |
| 4,099,040 | 7/1978 | Bitko | 200/220 |
| 4,135,067 | 1/1979 | Bitko | 200/220 X |
| 4,219,708 | 8/1980 | Rubey | 200/220 X |
| 4,260,970 | 4/1981 | Bitko | 335/52 |
| 4,493,066 | 1/1985 | Ubukata et al. | 200/220 X |

*Primary Examiner*—J. R. Scott

*Attorney, Agent, or Firm*—Burns, Doane, Swecker & Mathis

[57] ABSTRACT

A shock sensor has a mercury-wetted insert for supporting a mercury mass normally space from a terminal. The mercury and terminal are contained within a sealed housing. When the sensor is subjected to a shock, the mercury is redistributed and protrudes from the insert so as to contact the terminal and complete a circuit between that terminal and another terminal that is normally in communication with the mercury.

27 Claims, 11 Drawing Figures

Fig. 3A
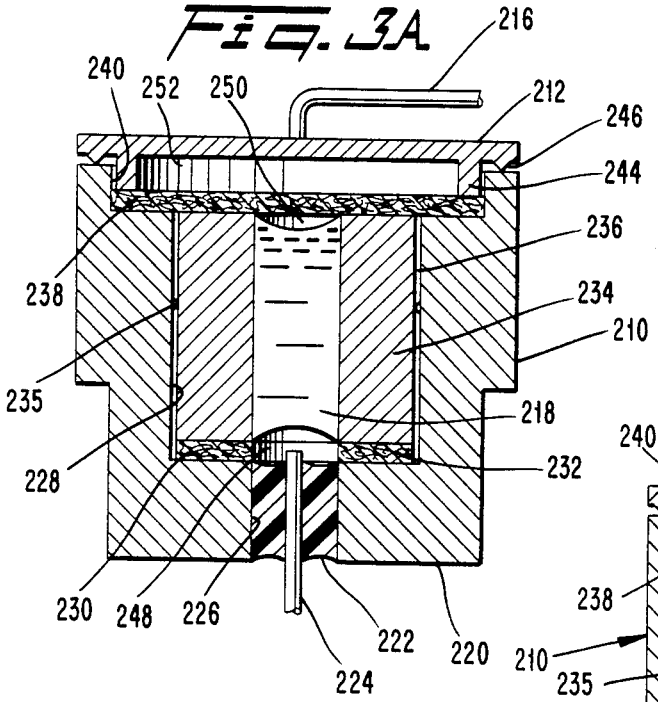
Fig. 3B
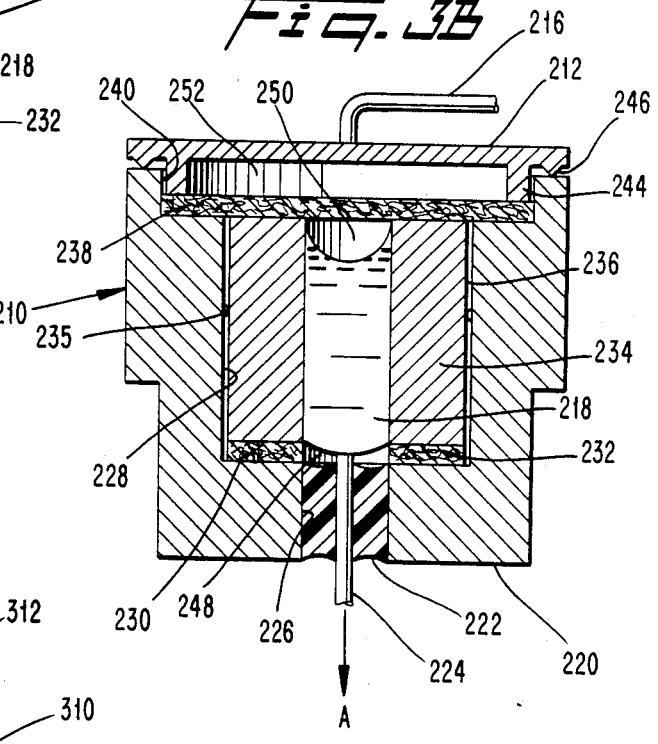
Fig. 4A
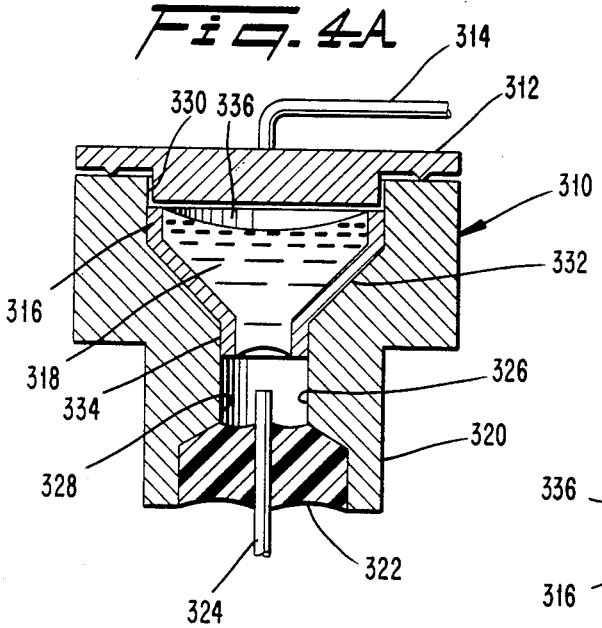
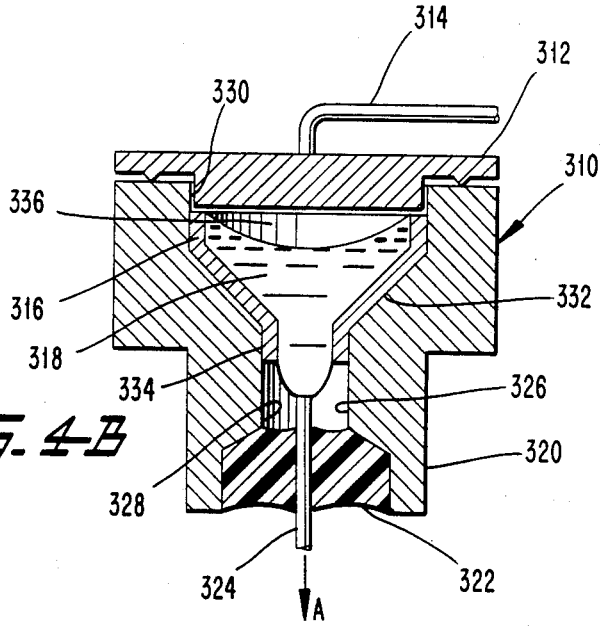
Fig. 4B

Fig. 5A
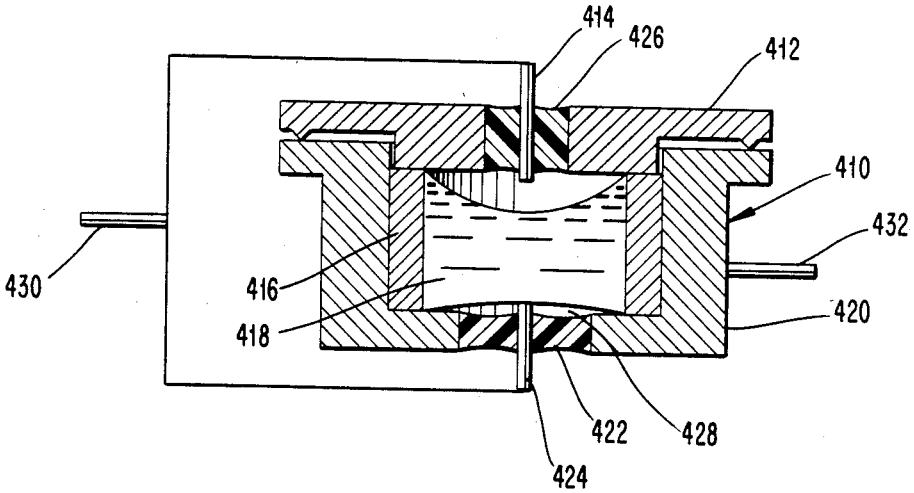
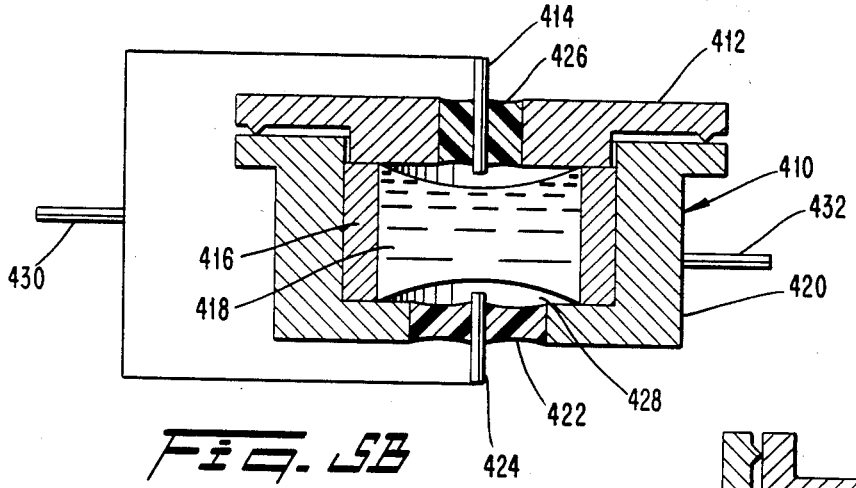
Fig. 5B
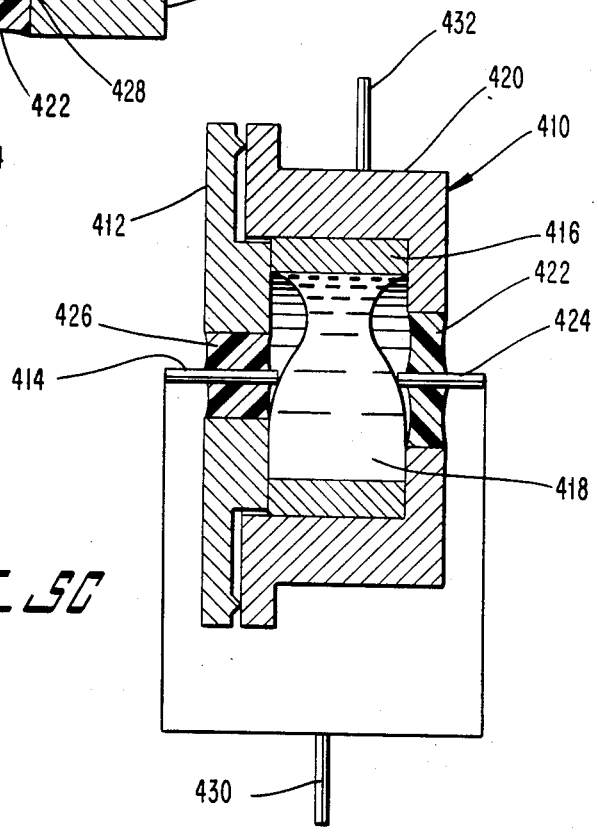
Fig. 5C

POSITION INSENSITIVE SHOCK SENSOR

BACKGROUND OF THE INVENTION

1. Field of the Invention

The present invention relates to position insensitive shock sensors, and more particularly to position insensitive shock sensors using conductive liquids to complete an electric circuit.

2. Description of Related Art

A variety of shock or deceleration/acceleration sensors have been developed in the past.

One type of shock sensor includes a weight, electrically connected to a terminal contact, suspended by a coil spring above a second terminal contact. When subjected to an appropriate shock, the weight overcomes the spring force and makes contact with the second contact, thus completing an electric circuit. A problem with these spring-type shock sensors is that vibration is created as a result of a shock. A related problem is that the electrical connection between the two contacts will be repeatedly interrupted because of the bounce of the spring supported contact. Such interruptions can promote contact degradation and produce erroneous signals. An additional problem is that the electrical circuit must usually include the spring supporting the weight. For sensors designed to be used in low G fields, the spring will have a fairly small diameter and/or a long wire length. These factors add undesirable electrical resistance to the circuit.

Another type of shock sensor includes a weighted contact supported on a flexible cantilever-type spring. These sensors also suffer from the vibration and the contact-bounce problems discussed above with respect to the coil-spring shock sensors.

Another type of shock sensor includes a strain gage mounted on a cantilevered plate that is designed to deflect in the region where the strain gage is mounted under shock or deceleration/acceleration forces. These sensors are relatively expensive to produce, and the electronics required to interpret the strain gage signals can be bulky.

Another type of shock sensor includes a flexible diaphragm spring that is suspended above a terminal contact. The diaphragm spring is connected to a second contact and is wetted with a thin layer of mercury on the surface facing the terminal contact. In the event of a shock, the diaphragm spring is deflected such that the mercury wetted surface contacts the terminal contact. Such a device does not have the above-described problems associated with contact bounce, but may not be usable over a wide range of G forces.

An additional problem with the above-described shock sensors is that they contain moving shaped-fixed, i.e., solid, parts that can be permanently deformed during a large shock.

Problems generally associated with spring-based shock sensors may be avoided by several other proposed devices which incorporate liquids, such as mercury, that are capable of conducting electricity. Such mercury based shock sensors would not generally need to include moving solid parts.

One such device is disclosed in U.S. Pat. No. 4,138,600. That patent discloses a force-responsive device that includes a housing having an hourglass-shaped interior with electric contacts projecting into it. The interior of the housing is not mercury-wettable. A contact medium, such as mercury, is governed by capillary adhesion, surface tension, and acceleration or deceleration forces to move within the housing interior to make or break electric circuits between the contacts. Actuation of the disclosed sensor causes mercury separation. The mercury must then be recollected by an external action.

Another mercury-based device is disclosed in U.S. Pat. No. 3,739,191. That patent discloses an acceleration/deceleration sensor having a tubular member with an electrode at one end and a so-called "deformable" element at the second end. Rapid acceleration/deceleration causes mercury to shift toward that second end of the tubular member and accumulate thereby creating a cavity at the other end of the member having the electrode. The interior of the sensor is not mercury-wettable. With the mercury separated from the electrode, the circuit is broken. The cavity is intended to create a vacuum for returning the mercury to its original position, and under a long-term deceleration/acceleration, the vacuum may be lost.

Another shock sensor is disclosed in U.S. Pat. No. 4,219,708. That patent discloses a shock switch that comprises a reservoir of conductive liquid held by surface tension against a non-mercury-wettable surface above a nonconductive region of gas. In the event of a shock or acceleration/deceleration, the surface tension is overcome causing the liquid to drop onto a pair of closely spaced electrical contacts and complete a circuit. The device is reset by an external force to return the conductive liquid to its position above the contacts.

Mercury-based operations have also been employed in relay switches intended to be operated by magnetic fields, not shocks. For example, attitude insensitive mercury relays are disclosed in U.S. Pat. Nos. 3,646,490; 3,697,906; 3,831,118; and 3,976,960. The disclosed relays include an enclosure having a flexible armature located within the enclosure adjacent an electric contact terminal. In each relay, the armature is mercury-wetted and covered with a thin layer of mercury that is intended to enhance the electrical contact between the armature and the contact. The mercury layer is not intended for protrusion from the armature, and is too thin for such protrusion. An electric coil adjacent the enclosure moves the armature into electrical contact with the terminal when the coil is energized by a current. In embodiments of U.S. Pat. No. 3,646,490, a space on the side of the armature opposite the contact terminal additionally is fillable by a layer of mercury (see, col. 3, lines 34–37).

A magnetic piston mercury switch is disclosed in U.S. Pat. No. 3,308,405. That patent discloses a switch having two mercury wettable tubes filled with mercury, the tubes being arranged in alignment with each other and separated by a mass of powdered iron. Contact terminals are arranged adjacent each opposite end. To activate the switch, a magnetic field draws the mass of iron toward one of the tube ends. This movement causes a displacement of the mercury within both tubes such that contact between the mercury and the contact terminals is either made or broken.

Mercury relays are also disclosed in U.S. Pat. Nos. 3,144,533; 3,715,546; 3,786,217; and 3,867,603. Those patents disclose relays having a shuttle slidably mounted within a tube. A thin layer of mercury is arranged between the shuttle and the tube to enhance electrical contacts and to reduce friction between the shuttle and the tube.

OBJECTS AND SUMMARY OF A PREFERRED FORM OF THE INVENTION

It is an object of the present invention to provide a novel, inexpensive shock sensor that produces reliable results.

More particularly, it is an object of the present invention to provide a novel shock sensor that does not produce an irregular signal because of contact bounce.

It is another object of the present invention to provide a novel shock sensor that does not rely on a coil or mechanical spring.

Still another object of the present invention is to provide a novel shock sensor that does not contain any moving solid parts that could be permanently deformed as a result of a large shock.

Yet another object of the present invention is to provide a novel shock sensor that does not create undesirable vibration.

It is still another object of the present invention to provide a novel shock sensor that does not have a high resistance circuit.

It is yet another object of the present invention to provide a novel shock sensor that does not have to be reset by an external force after being subjected to a shock.

It is still another object of the present invention to provide a novel shock sensor that can be used over a wide range of shock forces.

These and other objects of the present invention are accomplished with a preferred form of the invention by providing a shock sensor for sensing shock directed in a given direction having a housing containing a volume of an electrically conductive liquid and having an interior surface that is not wettable by that liquid. A rigid insert is arranged within the housing, the insert having a support surface wetted by the electrically conductive liquid. A first contact terminal is arranged in electrical communication with the insert, and a second contact terminal is electrically insulated from the insert and is arranged within the housing adjacent the volume of electrically conductive liquid that is supported by the insert. The volume of electrically conductive liquid and the area of the wetted support surface are such that the electrically conductive liquid, while wetted to the support surface, moves into electrical contact with the second contact terminal in response to shocks and is thereafter restored.

Other objects, advantages and features of the preferred forms of the invention will become hereinafter apparent by reference to the following detailed description and to the several views illustrated in the attached drawings.

BRIEF DESCRIPTION OF THE DRAWINGS

FIG. 3A is a view in cross section of a third preferred embodiment of the shock sensor according to the present invention;

FIG. 3B is a view in cross section of the shock sensor depicted in FIG. 3A while subjected to a shock;

FIG. 4A is a view in cross section of a fourth preferred embodiment of the shock sensor according to the present invention;

FIG. 4B is a view of the shock sensor depicted in FIG. 4A while subjected to a shock;

FIG. 5A is a view in cross section of a fifth preferred embodiment of the shock sensor according to the present invention;

FIG. 5B is a view of the shock sensor depicted in FIG. 5A while subjected to a less than 1 G field; and FIG. 5C is a view in cross section of the shock sensor depicted in FIG. 5A while positioned in an alternative orientation.

DETAILED DESCRIPTION OF THE PREFERRED EMBODIMENTS

Figure 1A:
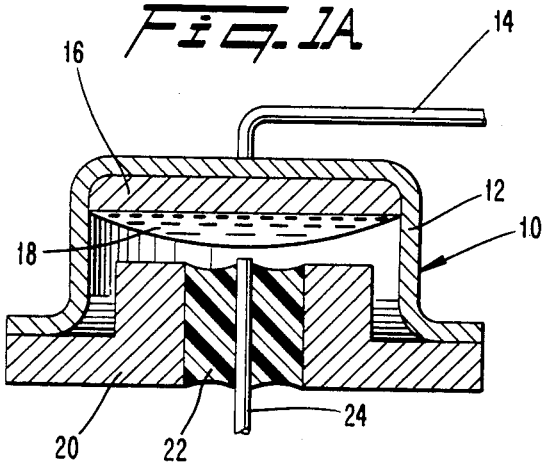
FIG. 1A is a view in cross section of a first embodiment of the shock sensor according to the present invention.

Referring now in detail to the drawings, wherein like parts are designated by like reference numerals throughout, with specific reference to FIG. 1A, a first embodiment of the shock sensor 10 according to the present invention is depicted in an at rest configuration.

Throughout the detailed description, references made to shocks include shocks caused by either rapid acceleration or deceleration.

The first embodiment of the shock sensor 10 has a housing 12. Connected to the outside of the housing 12 is a first contact terminal 14. The housing 12 comprises a non-mercury-wettable, electrically conductive material, such as steel, and is capable of conducting a charge from the terminal 14 to the interior of the housing 12.

A mercury-wettable, electrically conductive, insert 16 is mounted in an electrically conductive engagement with the interior of the housing 12. Preferred materials for the insert 16 include nickel-copper or nickel-platinum alloys. As an alternative to use of a mercury-wettable insert 16, the interior surface of the housing 12 may be treated, such as by plating with a mercury-wettable material, so as to render a portion of the interior housing surface itself mercury-wettable. A thick layer of mercury is placed in contact with the mercury-wettable surface of the insert 16 or in contact with the mercury-wettable interview housing surface. The layer of mercury 18 is sufficiently thick that the mercury 18 is not uniformly distributed across the surface to which it is wetted, but rather is easily subject to gravitational and other forces. In a steady-state, i.e., with no acceleration or shocks acting on the mercury, the mercury layer 18 is thickest at the center of the insert 16.

As used herein, the term insert includes the treated interior surface of the housing.

A base 20 is provided for the housing 12. The base 20 comprises a non-mercury-wettable, electrically conductive material, such as steel, and has a central bore therethrough. A nonconductive, non-mercury-wettable core 22, such as glass or an elastomeric material is provided in the bore so as to support a second contact terminal 24 therein. The second contact terminal 24 is arranged such that one end thereof projects into the housing and one end projects out of the housing.

The base 20 is attached to the housing 12 by welding, or other suitable means. The entire housing is hermetically sealed and the mercury layer 18 is suspended directly above the second contact terminal 24. When the shock sensor 10 is at rest, the surface tension of the mercury layer 18 holds the mercury together such that a gap is created between the mercury 18 and the second contact terminal 24. A gas compatible with the mercury 18, such as hydrogen is provided within the hermetically sealed housing.

The surface tension of a liquid is a force that causes a droplet of the liquid to assume a spherical shape in a zero gravity field. However, the shape and position of a body of liquid at rest and under conditions of constant pressure and temperature depend upon the equilibrium of three forces. These are (1) the surface tension of the liquid, (2) the magnitude and direction of all forces, including gravity, acting on the liquid, and (3) the degree of wetting between the liquid and any solid surface in contact with the liquid.

For further details concerning surface tension, see chapter 6 of B. Brown, General Properties of Matter, Plenum Press, 1969, the subject matter of which is hereby incorporated herein.

The surface tension of mercury is relative high compared to the surface tension of many other liquids. The relatively high surface tension allows a large quantity of mercury to adhere to a surface to which it is wetted. Accordingly, with continued reference to FIG. 1A, it will be appreciated that gravitational forces combine with surface tension to cause the mercury 18 to collect toward the center of the insert 16, which is arranged directly above the second contact terminal 24.

A surface is considered to be wetted with a liquid if the liquid forms a low contact angle with the surface. A small quantity of liquid on a non-wetted surface will tend to bead, while on a wetted surface, the liquid will tend to spread itself uniformly over the wetted surface. In addition, as a result of an impact, the liquid will leave a non-wetted surface without generating any restoring surface tension forces, whereas resisting forces will be present in the case of a liquid wetted to a surface.

Figure 1B:
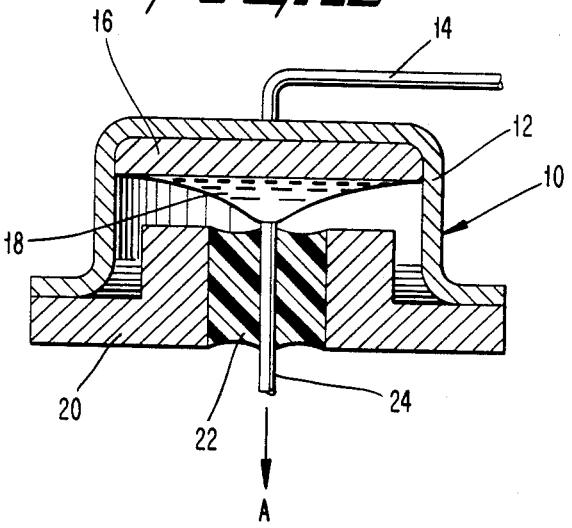
FIG. 1B is a view of the shock sensor depicted in FIG. 1A while subjected to a shock.

With reference now to FIG. 1B, it will be appreciated that if the shock sensor 10 is abruptly decelerated while travelling in the direction of arrow A, or experiences a similar shock, the mercury 18 will be displaced toward the contact 24 as shown, largely by reason of a force in the direction of arrow A proportional to the deceleration. This force will be referred to as Force A. The combined effect of Force A, gravity, and the surface tension of the mercury causes the mercury to redistribute and protrude from the insert 16 as shown. If Force A is greater than a predetermined value, the mercury 18 will protrude sufficiently to contact the second contact terminal 24. The tip of the second contact terminal 24 may be mercury-wettable so as to facilitate an electrical connection between the mercury 18 wetted to the insert 16 and to the second contact terminal 24.

When the mercury 18 contacts and wets to the tip of the second contact terminal 24, the surface tension of the contacting mercury 18 will cause the mercury 18 to stay temporarily in electrical contact with the second contact terminal 24, even though the center of gravity of the mercury 18 may tend to oscillate for a brief period, thus avoiding contact bounce problems. When the mercury 18 contacts the second contact terminal 24, a circuit is completed from the first contact terminal 14 to the second contact terminal 24 by means of the housing 12, the insert 16 (if employed), and the mercury 18.

After the shock is over, the surface tension of the mercury 18 wetted to the insert 16, or to the wettable portion of the housing interior, restores the mercury 18 back to its original configuration thus breaking the circuit between the contact terminals 14, 24. The volume of mercury 18 within the housing is preferably greater than half of the available space within the housing. This helps to ensure that the mercury 18 does not separate from its wettable support surface during a large shock.

Figure 2A:
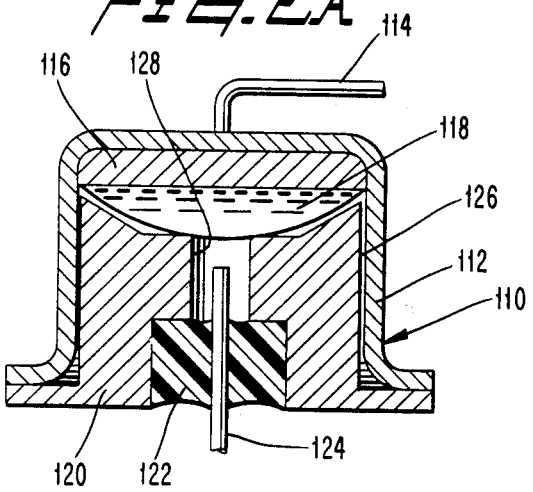
FIG. 2A is a view in cross section of a second preferred embodiment of the shock sensor according to the present invention.

With reference now to FIG. 2A, a second preferred embodiment of the shock sensor 110 of the present invention is provided in an at rest, i.e., steady-state, configuration. Parts of the second preferred embodiment corresponding to similar parts of the first preferred embodiment are referenced with like reference numerals increased by 100.

With continued reference to FIG. 2A, a housing 112 of electrically conductive, non-mercury-wettable material, such as steel, is provided with a first contact terminal 114 electrically connected to the outside of the housing 112. An insert 116, comprised of an electrically conductive, mercury-wetted material is mounted to the inside of the housing 112. Preferred materials for the insert 116 include nickel-copper alloys or nickel-platinum alloys. Alternatively, instead of using the insert 116, a portion of the interior surface of the housing 112 may be plated with a mercury-wettable material. A layer of mercury 118 is wetted to the insert 116 on the plated interior surface. The layer of mercury 118 is sufficiently thick that the mercury 118 is not uniformly distributed across the mercury-wetted surface, but rather, it takes a shape more readily influenced by gravitational and other forces. In a steady-state configuration, the mercury 118 is thickest at the center of the mercury-wetted surface.

A first contact terminal 114 is mounted to the exterior of the housing 112 such that a complete circuit from the first contact terminal 114 is provided through the housing 112 and the insert 116 (or plating) to the mercury 118. A base 120 of the shock sensor is comprised of an electrically conductive, non-mercury-wettable, material such as steel.

The base 120 has a tubular interior extension 126 extending from the center of the base 120. The extension 126 has a central bore 128 therethrough. A second contact terminal 124 is sealingly mounted in a non-mercury-wettable core 122 arranged in the bore 128 of the base 114. The core 122 is comprised of glass or any suitable non-conductive material.

The core 122 does not fill the entire bore 128, and the second contact terminal 124 is arranged in the core 122 such that one end of the terminal 124 extends externally of the base 120 and the other end of the terminal 124 is concentrically contained within the bore 128.

The extension 126 has an upper edge surface 130, and the housing 112 is welded or otherwise attached to the base 120 such that when the shock sensor 110 is at rest, the mercury 118 will suspend from the mercury-wetted surface adjacent the upper end surface 130. A mercury compatible gas, such as hydrogen, is provided within the hermetically sealed housing.

Figure 2B:
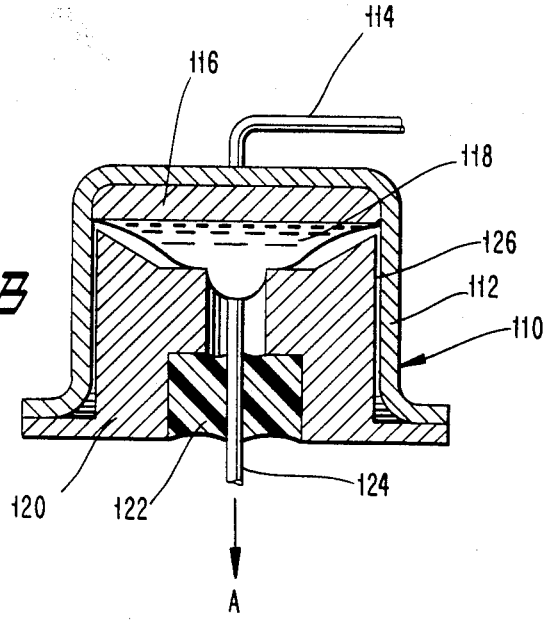
FIG. 2B is a view of the shock sensor depicted in FIG. 2A while subjected to a shock.

With reference now to FIG. 2B, if the shock sensor 110 is travelling in the direction of arrow A, and is subjected to abrupt deceleration, or experiences a similar shock, a force (Force A) will be exerted upon the mercury 118 in the direction of arrow A. The combined effect of the mercury's surface tension, the Force A, and gravity causes the mercury to redistribute and protrude from the mercury-wetted surface without separating, as shown. The upper end surface 130 and the bore 128 of the extension 126 support and guide the mercury 118 during such a shock. The extension 126 helps to prevent the mercury 118 from separating during an abrupt shock or deceleration. In addition, preferably the volume of mercury 118 is greater than on-half of the available space within the enclosure.

If the shock is greater than a predetermined value, the mercury 118 will contact the second contact terminal 124 and complete a circuit between the first and second contact terminals 116, 124. Once the shock is over, the surface tension draws the mercury back to its original configuration on the mercury wetted surface thus breaking the circuit between the contact terminals.

With reference now to FIG. 3A, a third preferred embodiment of the shock sensor 210 of the present invention is provided in an at rest configuration. A base 220 of the shock sensor 210 is provided with three concentric cylindrical surfaces 226,228,240 on the interior thereof, and two corresponding stepped surfaces 230,238 interconnecting the concentric cylindrical surfaces. The base 220 is comprised of an electrically conductive, non-mercury-wettable material, such as steel.

Within the first interior cylindrical surface 226 of the base 220 is located a nonconductive, non-mercury-wettable core 222, comprised of glass or any other suitable material. The second contact terminal 224 is concentrically mounted in the core 222 such that one end of the terminal 224 extends in the sensor, but so as not to be in electrical communication with any other surface of the shock sensor 210 when the shock sensor 210 is at rest.

Concentric with the first interior cylindrical surface 226 is a second interior cylindrical surface 228, which has a larger diameter than the first interior cylindrical surface 226 and is interconnected therewith by a first stepped surface 230. Seated within the second interior cylindrical surface 228 upon the first stepped surface 230 is a gasket 232. The gasket 232 is made from a fibrous felt-type material that is air permeable and mercury impermeable. Seated upon the gasket 232 within the second interior surface 228 is a tubular insert 234. The insert 234 and the gasket 232 have internal diameters substantially equal to the diameter of the first interior surface 226.

The interior of the tubular insert 234 is mercury-wettable and is completely filled with a mercury 218 with the exception of a meniscus formed at each end of the insert 234. The outside diameter of the tubular insert 234 is at least 0.002" less than the diameter of the second interior surface 228 such that a 0.001" gap 236 exists between the insert 234 and the second interior surface 228. Protrusions 235 selectively spaced on the insert 234 provide an electrical contact between the base 220 and the insert 234, which is also electrically conductive.

Adjacent to the end of the insert 234 that is opposite the gasket 232, a second stepped surface 238 interconnects the second interior surface 228 with a third cylindrical interior surface 240. The third interior surface 240 is concentric with and has a larger diameter than the second and first interior surfaces 228, 226.

A second gasket 242 is circular in shape and has an outer diameter substantially equal to the diameter of the third interior surface 240. The second gasket 242 is arranged on the second stepped surface 238 and the insert 234, and is also air permeable and mercury impermeable.

A cover plate 212 is made of non-mercury wettable, electrically conductive material, such as steel, and has an outer diameter substantially equal to the outer diameter of the base 220. A first contact terminal 216 is mounted to the outside of the plate 212. An annular projection 244 extends from the inside of the cover plate 212 and coacts with the second stepped surface 238 to engage the second gasket 242. The cover plate 212 is welded or similarly fastened to the base 214 along an annular ridge 246. Before being welded closed, the sensor 210 is filled with a mercury compatible gas, such as hydrogen.

A first air space 248 is provided between the mercury 218 and the second contact terminal 224. A second air space 250 is provided between the mercury 218 and the second gasket 242, and a third air space 252 is provided between the cover plate 212 and the second gasket 242. The volume of mercury 218 is preferably greater than half of the available space between the second gasket 242 and the core 222.

With reference now to FIG. 3B, when the shock sensor 210 is decelerated quickly while travelling in the direction of arrow A, or is subjected to a similar shock, a force, referred to as Force A, is exerted on the mercury in the direction of arrow A. Force A coacts with gravity to protrude the mercury 218 from the insert 234. As the mercury 218 descends into the first air space 248, air present therein is forced through the air permeable gasket 232, through the gap 236 between the base 220 and the insert 234, and through the second air permeable gasket 242 into the third air space 252.

Simultaneously, as a combined result of the influx of this air into the third air space 252, and the enlargement of the second air space 250 due to the mercury 218 descending into the first air space 248, air present in the third air space 252 is forced through the second gasket 242 into the second air space 250.

If the deceleration or shock is greater than a predetermined value, the mercury 218 will contact the second contact terminal 224, thus completing a circuit from the first contact terminal 216, through the cover plate 212, the base 220, the protrusions 235, the insert 234, the mercury 218 to the second contact terminals 216, 224. After the shock is over, the mercury 218 is retracted back into the insert 234 by means of the surface tension forces, thus breaking the circuit.

With a tubular insert both the height and diameter of the insert govern the extent of force required for the mercury to protrude from the insert. Since the weight of the mercury acts to extend the mercury and the surface tension acts to restrain the mercury, the propensity of the mercury to extend from the insert is balanced between the weight and surface tension. The weight of the mercury is proportional to the inside diameter of the insert squared times the height of the insert, while the surface tension is essentially proportional to the diameter of the insert.

Thus, as the diameter of the insert increases the weight of the mercury increases logarithmically, while the surface tension increases linearly. Therefore, the force required for the mercury to protrude from the insert decreases as the insert diameter increases. Since the weight of the mercury increases linearly with the height of the insert, and the height of the insert does not affect the surface tension, the force required to cause protrusion of the mercury decreases as the height of the insert increases. Accordingly, for sensitive shock sensors intended to sense small shocks, the insert diameter and height should be made larger than those of an insert intended to sense greater shocks. A preferred embodiment of the shock sensor 210 has an insert 234 diameter of 0.060" and a height of 0.180".

With reference now to FIG. 4A, a fourth embodiment of the shock sensor 310 is provided in an steady-state configuration. A base 320 is provided with a concentric bore 326 extending therethrough. The base 320 is comprised of an electrically conductive, non-mercury-wettable material, such as steel. At the bottom of the base 320, a core 322 of glass or other suitable electrically nonconductive, non-mercury-wettable material is arranged to concentrically and sealingly support a second contact terminal 324. The second contact terminal 324 projects into the bore 326.

At a center portion of the bore 326, the bore diameter increases gradually from a first diameter region 328 adjacent the second contact terminal to a second diameter region 330 adjacent the top of the base 320.

The region of the bore 326 where the diameter is increasing forms a conically shaped seat 332. Supported within the bore 326 upon the conically shaped seat 332 is a mercury-wettable insert 316. The insert 316 has an outer configuration conforming in shape to the bore 326, such that the insert 316 has a lower region 334 and an upper region 336 of expanded diameter. The insert 316 is comprised of an electrically conductive, mercury-wettable material, such as nickel-copper alloy or a nickel-platinum alloy.

Alternatively, instead of using the insert 316, a portion of the interior surface of the base 320 could be treated, such as by plating with a mercury-wettable material such as platinum.

The insert 316 (or the plated region of the base 320) is completely filled with mercury 318, except that a meniscus is formed at each end of the insert 316. The dimensions of the insert 316 are chosen such that the surface tension of the mercury 318 is able to retain the mercury 318 within the insert 318 under shock-free conditions.

Because of the expanded upper region 336, the insert 316 (or plated region of the base 320) is able to hold more mercury 318 than a straight tubular insert of the smaller diameter. In addition, the increased diameter of the upper region 336 of the insert 316 increases the surface tension of the mercury 318. During a rapid deceleration, the increased mass increases the inertia of the mercury 318, so that allowing it will to protrude from the insert 316 more readily than otherwise.

A cap 312 of electrically conductive, non-mercury-wettable, material, such as steel, is welded or otherwise fastened to the base 320. A first contact terminal 314 is connected to the cap 312 such that an electric circuit is completed from the first contact terminal 314, through the cap 312, the base 320, the insert 316, and the mercury 318.

Turning attention now to FIG. 4B, when the shock sensor 310 experiences a rapid deceleration while travelling in the direction of arrow A, or a similar shock, a Force A is exerted on the mercury 318 causing it to protrude from the insert 316 or plated region of the base. If the shock is large enough, the mercury 318 will contact the second contact terminal 324, thus completing a circuit between the first and second contact terminals 314, 324. When the shock is over, the surface tension of the mercury causes the mercury to retract into the insert 316.

In order to prevent mercury separation, the volume of mercury 318 is preferably greater than one-half of the available space within the housing. The remaining space is filled with a mercury compatible gas, such as hydrogen.

With reference now to FIG. 5A, a fifth preferred embodiment of the sensor 410 of the present invention is provided that is intended to sense a reduction in the gravitational force to which the sensor is exposed.

The illustration of the sensor 410 in FIG. 5B is intended to detect a situation where the sensor 410 is experiencing a gravity field of less than 1 G.

A base 420, comprising an electrically conductive, non-mercury-wettable material, such as steel, is provided with a bore in the center thereof. A core 422 of glass or other non-mercury-wettable, electrically nonconductive material is arranged within the bore of the base 420 so as to concentrically and sealingly support a second contact terminal 424. The second contact terminal 424 projects into the base 420.

A tubular insert 416 comprising an electrically conductive, mercury-wetted material, such as a nickel-copper or platinum-nickel alloy, is seated on a shoulder 428 within the base 420, and is filled with mercury 418. The height and diameter of the tubular insert 416 are chosen such that the surface tension of the mercury is not strong enough to contain the mercury within the insert under a gravity field of 1 G. As a result, under normal conditions, the mercury slightly from the insert 416 in a contacting relationship with the second contact terminal 424. (See FIG. 5A).

Alternatively, instead of the insert 416, a portion of the interior surface of the base 420 may be treated, such as by plating with a mercury-wettable material such as platinum.

At the top of the sensor 410, a cap 412 is provided. The cap 412 is comprised of an electrically conductive, non-mercury-wettable material, such as steel, and is welded or similarly attached to the base 420. The cap has a central bore therethrough and a core 426, similar to core 422, concentrically and sealingly maintains a first contact terminal 414 within the cap 412, such that a portion of the first contact terminal 414 extends within the sensor 410. When the sensor 410 is in a steady-state configuration, the mercury 418 within the insert 416 (or plated region of the base) has a meniscus at the end thereof adjacent the first contact terminal 414 such that the mercury 418 does not contact the first contact terminal 414.

Both terminals are electrically interconnected and further connected to a third terminal 430 exterior to the sensor 410. A fourth terminal 432 is electrically connected to an exterior of the base 420.

When the sensor 410 is oriented such that the first contact terminal 414 is above and in vertical alignment with the second contact terminal 424, and when the sensor 410 is in a 1 G gravity field, a circuit is completed between the fourth terminal 432 and the third terminal 430 via the second contact terminal 424 through the insert 416 and the mercury 418.

With reference now to FIG. 5B, when the sensor 410 is subjected to a gravity field of less than a predetermined value, the surface tension of the mercury 418 is able to retain the mercury 418 entirely within the insert 416 or plated region of the base. In this mode, a meniscus is formed at both ends of the mercury 418 such that the mercury 418 is not in contact with either of the first and second contact terminals 414,424.

With reference now to FIG. 5C, when the sensor 410 is provided in an orientation having the contact terminals 414, 424 extending in horizontal alignment with each other, and in a steady-state in a 1 G field, the mercury 418 tends to accumulate at the lower portion of the insert 416 such that the mercury 418 contacts both the first and second contact terminals 414,424, completing an electrical circuit between the third terminal 430 and the fourth terminal 432 through either of the first and second terminals 414, 424, the mercury 418, the insert 416 and the base 420. With reference again to FIG. 5B, if the sensor 410, is subjected to a gravity field of less than a predetermined amount, the surface tension of the mercury 418 redistributes the mercury more uniformly within the insert 416 (or plated region of the base) such that the mercury 418 does not contact either of the contact terminals 414, 424. Thus, the circuit between the contact terminals 430,432 is broken.

The sensor 410 can be used in any orientation. Thus, it can be used, in the manner described above, with either of the first and second contact terminals 414, 424 situated at the lower end of the sensor. It can also be used in angular orientations not disclosed in the figures.

With respect to all of the above disclosed embodiments of the present invention, it should be clear that electrically conductive liquids other than mercury may be suitable for use instead of the mercury. Furthermore, the sizes and shapes of the inserts can be modified within the principles of the present invention to accommodate for various shock levels intended to be tested.

Although only certain embodiments are specifically illustrated and described and herein, it will be appreciated that many other modifications and variations of the present invention are possible in light of the above teachings and within the purview of the appended claims without departing from the spirit and intended scope of the invention.

What is claimed is:

1. A shock sensor for sensing shock directed in a given direction, comprising:

a housing containing a volume of an electrically conductive liquid and having an interior surface that is not wettable thereby;

a rigid insert arranged within the housing, said insert presenting a support surface wetted by said electrically conductive liquid;

a first contact terminal in electrical communication with said insert;

a second contact terminal electrically insulated from said insert and arranged within the housing adjacent the volume of electrically conductive liquid supported by said insert;

said volume of electrically conductive liquid and the area of said wetted support surface being such that said electrically conductive liquid, while wetted to said support surface, moves into electrical contact with said second contact terminal in response to shocks and is thereafter restored.

2. The shock sensor of claim 1, wherein the insert is tubular and is filled with the electrically conductive liquid.

3. The shock sensor of claim 2, wherein the height and diameter of the tubular insert are such that when the shock sensor is at rest, surface tension of the liquid retains the liquid within the insert.

4. The shock sensor of claim 2, wherein the axis of the tubular insert extends in the given direction and the second contact terminal is arranged at one axial end of the insert.

5. The shock sensor of claim 2, wherein hydrogen gas is sealed within the housing.

6. The shock sensor of claim 2, further comprising means arranged at each end of the tubular insert for separating the insert from the housing.

7. The shock sensor of claim 6, wherein said separating means are air permeable and impermeable to the liquid.

8. The shock sensor of claim 7, further comprising means arranged between the insert and the housing for allowing a gas to pass between each of the insert.

9. The shock sensor of claim 1, wherein the volume of liquid is greater than one-half of the available space within the housing.

10. The shock sensor of claim 2, wherein the tubular insert has a reduced diameter at one end, an enlarged diameter at the other end and a conically sloping surface interconnecting the two ends.

11. The shock sensor of claim 1, wherein the liquid is mercury.

12. A shock sensor for sensing shock directed in a given direction, comprising:

a housing having an interior surface that is not wettable by an electrical conductive liquid;

an insert surface within said housing, said surface wetted by an electrically conductive liquid;

a volume of the electrically conductive liquid located on the wetted surface;

a first contact terminal in electrical communication with the wetted surface;

a second contact terminal arranged within the housing adjacent the volume of electrically conductive liquid, said second contact terminal being isolated by material that is neither electrically conductive nor wettable by the electrically conductive liquid;

said volume being sufficiently thick such that when the shock sensor is subjected to a shock in the given direction of a magnitude intended to be sensed by the shock sensor said volume is redistributed to protrude from the wetted surface and makes electrical contact with the second contact terminal.

13. The shock sensor of claim 12, wherein the interior of the housing, except for the wetted surface, is comprised of a material that is not wettable by the liquid.

14. The shock sensor of claim 12, wherein hydrogen gas is sealed within the housing.

15. The shock sensor of claim 12, wherein a tip of the second contact terminal adjacent the layer is wetted by the liquid.

16. The shock sensor of claim 12, further comprising a tubular extension of the housing extending within the housing concentrically with respect to the second contact terminal.

17. The shock sensor of claim 16, wherein the second contact terminal is recessed within the tubular extension.

18. The shock sensor of claim 12, wherein the liquid is mercury.

19. The shock sensor of claim 12, wherein the wetted surface is rigid.

20. A low gravity field sensor, comprising:

a housing;

a rigid insert arranged within the housing, said insert having a surface wetted by an electrically conductive liquid;

said housing being in electrical communication with said insert;

a first contact terminal arranged within the housing below the insert surface, said terminal being surrounded by a material that is neither electrically conductive nor wettable by the liquid;

a volume of the liquid arranged on the insert surface, said volume being of sufficient thickness such that in a 1 G field, gravity redistributes the volume such that the liquid protrudes from the insert surface and is in contact with the first contact terminal, said volume being sufficiently thin such that when the gravity field is reduced below a predetermined level, surface tension of the liquid retracts the liquid off of the first contact terminal.

21. The sensor of claim 20, wherein the rigid insert is tubular and the interior surface is wetted and filled with the electrically conductive liquid.

22. The sensor of claim 21, wherein the diameter and height of the insert are such that when the sensor is at rest in a 1 G field, the liquid extends from the insert and contacts the first contact terminal, yet when the sensor is at rest in a gravity field of less than a predetermined value, the surface tension of the liquid draws the liquid into the insert such that the liquid is not in contact with the first contact terminal.

23. The sensor of claim 22, further comprising a second contact terminal arranged at the opposite end of the insert as the first contact terminal.

24. The sensor of claim 23, wherein said first and second contact terminals are arranged such that when the sensor is oriented with the terminals in horizontal alignment with each other, the liquid contacts both of the first and second terminals when the sensor is at rest in a 1 G gravity field, and when the sensor is subjected to a gravity field below a predetermined level, the surface tension of the liquid orients the liquid within the insert such that the liquid does not contact either of the first and second contact terminals.

25. The sensor of claim 20, wherein the liquid is mercury.

26. The sensor of claim 20, wherein the housing is filled with hydrogen gas.

27. The sensor of claim 20, wherein the volume of mercury is greater than one-half of the available space within the housing.

* * * * *